US008011032B2

(12) United States Patent
Cline et al.

(10) Patent No.: US 8,011,032 B2
(45) Date of Patent: Sep. 6, 2011

(54) ENERGY EFFICIENT CIRCULATION SYSTEM FOR SPAS AND HOT TUBS

(75) Inventors: David J. Cline, Newport Beach, CA (US); Loren R. Perry, Fountain Valley, CA (US)

(73) Assignee: Balboa Instruments, Inc., Tustin, CA (US)

( * ) Notice: Subject to any disclaimer, the term of this patent is extended or adjusted under 35 U.S.C. 154(b) by 1120 days.

(21) Appl. No.: 11/750,255

(22) Filed: May 17, 2007

(65) Prior Publication Data

US 2008/0282459 A1 Nov. 20, 2008

(51) Int. Cl.
*E04H 4/00* (2006.01)

(52) U.S. Cl. ..... 4/509; 4/512; 4/506

(58) Field of Classification Search ..... 4/509, 512, 4/506

See application file for complete search history.

(56) References Cited

U.S. PATENT DOCUMENTS 3,010,401 A 11/1961 Granqvist
3,701,427 A * 10/1972 Howard ..... 210/167.1
3,969,043 A 7/1976 Bright et al.
4,854,373 A 8/1989 Williams
4,858,254 A 8/1989 Popovich et al.
5,930,852 A * 8/1999 Gravatt et al. ..... 4/541.1
6,200,108 B1 * 3/2001 Caudill et al. ..... 417/366
6,282,370 B1 8/2001 Cline et al.
6,643,108 B2 11/2003 Cline et al.
6,966,079 B2 * 11/2005 Stetson ..... 4/508
7,030,343 B2 4/2006 Tran
7,065,804 B2 * 6/2006 Rickman ..... 4/498
7,523,873 B1 * 4/2009 Lopes ..... 237/12.3 B
2002/0047006 A1 * 4/2002 Cline et al. ..... 219/497

* cited by examiner

*Primary Examiner* — Gregory Huson
*Assistant Examiner* — Karen L Younkins
(74) *Attorney, Agent, or Firm* — Larry K. Roberts

(57) ABSTRACT

A method and apparatus for circulating water in a bathing installation with a water circulation flow path and a tub for holding bathing water is described. A pump is submerged in a chamber in the circulation flow path so that the pump when operated provides a positive pump pressure to pump water through the circulation flow path from an inlet opening to an outlet opening. Thermal contact is provided between a pump housing surface and water in the chamber to allow heat transfer between the pump housing surface and water in the chamber.

23 Claims, 6 Drawing Sheets

ENERGY EFFICIENT CIRCULATION SYSTEM FOR SPAS AND HOT TUBS

BACKGROUND

Bathing installations, such as spas and pools, may employ a circulation water flow path and a pump connected to pump water through the circulation water flow path. In one typical application, this circulation system provides movement of the water through a filter to clarify the water, and through a heater to facilitate effective heating of the water. A significant amount of heat may be generated by the pump during operation, and the heat energy is typically wasted unless collected by a complex cooling system.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1:
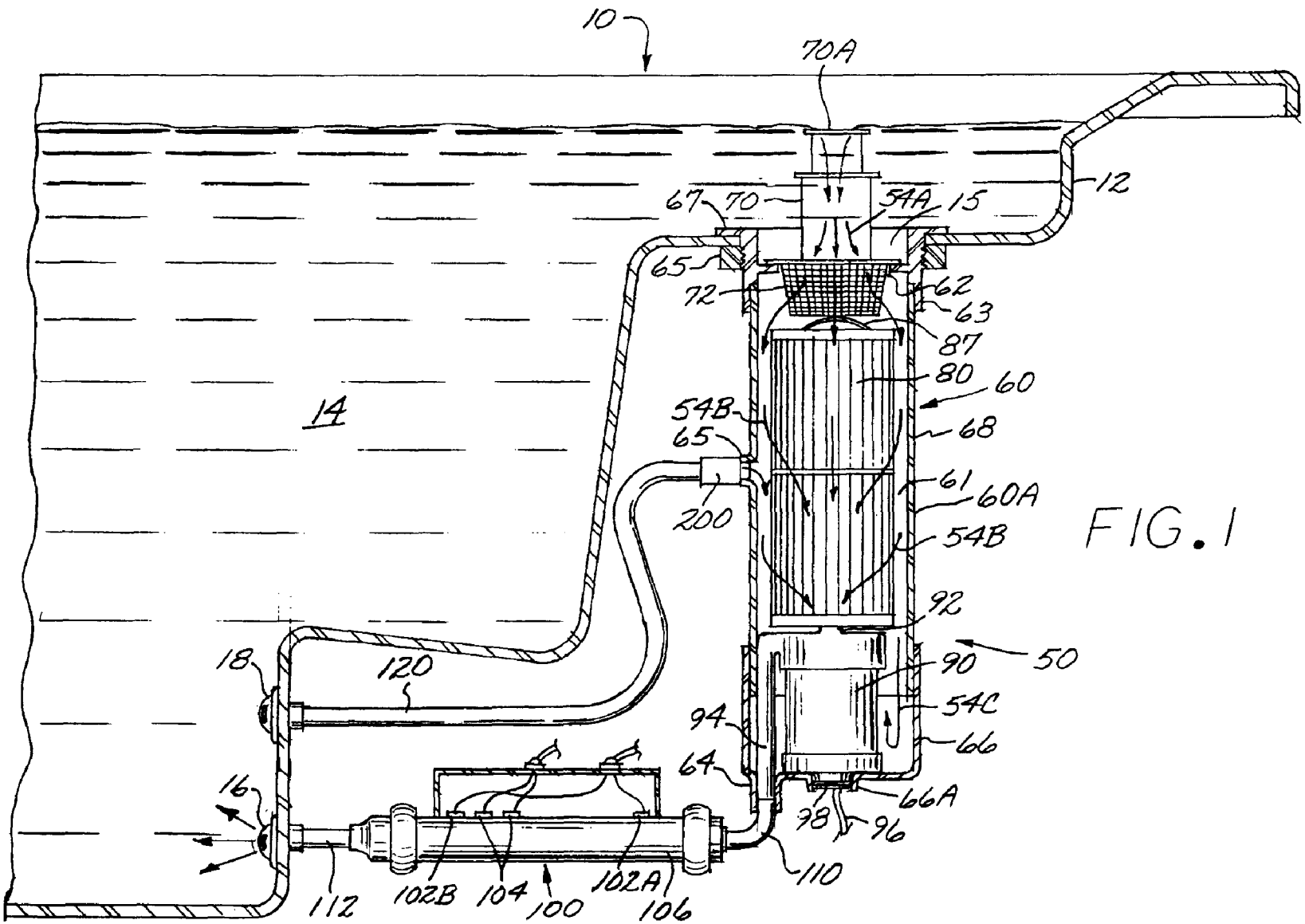
FIG. 1 is a diagrammatic side cross-sectional view of an exemplary embodiment of a water conditioning system for a bathing installation system.

In the following detailed description and in the several figures of the drawing, like elements are identified with like reference numerals. The figures may not be to scale, and relative feature sizes may be exaggerated for illustrative purposes.

An exemplary embodiment of a bathing installation 10 is diagrammatically depicted in FIG. 1. The bathing installation, which may be a spa system in an exemplary embodiment, includes a water receptacle 12, e.g. a spa tub, for holding a body 14 of water. In an exemplary embodiment, the bathing installation includes a circulation water conditioning system 50. The water conditioning system may include a housing structure 60 adapted to be connected to an opening 15 defined in the tub 12. The housing structure 60 may have a circular cross-section for ease of construction, but other configurations may alternatively be employed. The structure 60 includes a main inlet port 62, and an outlet port 64, and has an interior chamber 61.

In an exemplary embodiment, a floating skimmer or weir 70 is positioned with a skimmer basket 72 at the inlet port 62, and has an open top 70A. In this exemplary embodiment, water enters the inlet port through the open top of the floating skimmer and passes through the skimmer basket 72 into the housing structure 60, as generally indicated by arrows 54A.

The skimmer basket may provide a coarse filtration of large foreign matter, such as leaves or other large items.

A second filtration function may be provided in the conditioning system 50, e.g., by a filter cartridge 80 enclosed within the housing structure 60. The conditioning system 50 further comprises, in this exemplary embodiment, a circulation pump 90 disposed within the housing structure. In an exemplary embodiment, the housing structure is adapted to support the filter cartridge 80 and the pump such that water which enters the housing structure through the inlet port 62 passes through the filter cartridge 80 as indicated by arrows 54B, and enters the pump 90 at pump inlet 92. The pump 90 has an outlet 94, which is in fluid communication with the housing outlet port 64.

In an exemplary embodiment, the housing structure 60 may include a canister end cap 66 which is attached at an end of a generally cylindrical housing member or barrel member 60A. The end cap 66 is illustrated in further detail in the enlarged fragmentary view of FIG. 2, and may be adapted to include an electrical wiring port 66A at a bottom end thereof to allow an electrical cord 96 to pass through to a source of electrical power. The electrical power source may be through a control system, as will be described more fully. A gasket or seal 98 may be provided to prevent water from leaking through the port 66A.

Figure 2:
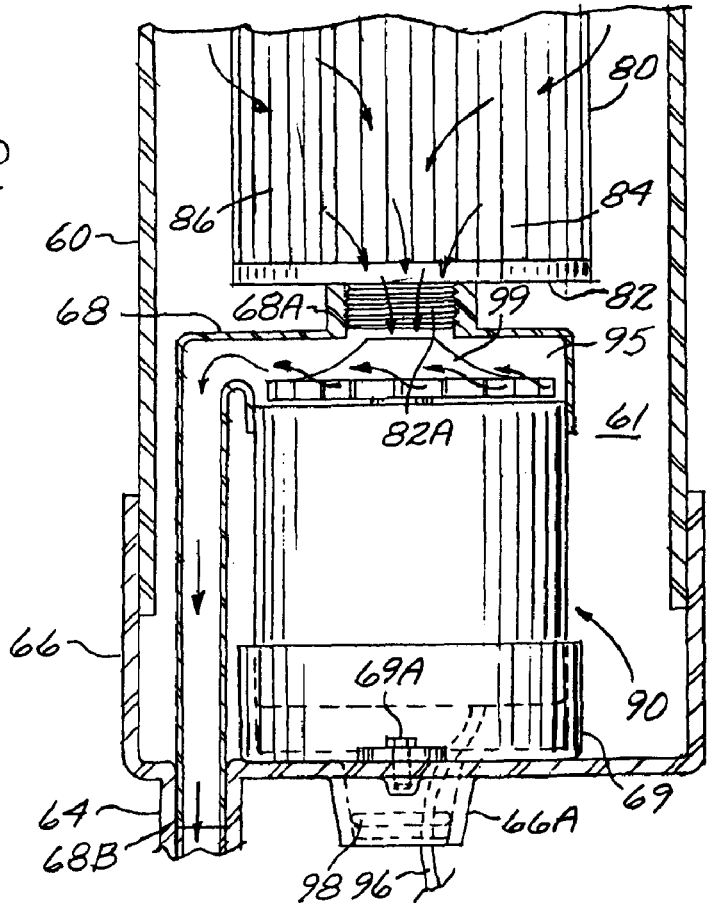
FIG. 2 is an enlarged view of a portion of the system illustrated in FIG. 1.

FIG. 2 depicts an exemplary mounting arrangement for the pump 90 within the housing structure 60. The filter cartridge 80 may include a bottom rigid plate member 82 having a hollow threaded male fitting 82A. The filter cartridge may include filter media 86, which may be porous, and serve to capture particulates from water passing through the filter cartridge. Filter cartridges suitable for the purpose are commercially available. One example is the cartridge marketed by Unicel as the 7CH-402 cartridge. An example of suitable filter media is permeable polyester. A pump discharge housing 68 may fit over one end of the pump, and include a threaded inlet port 68A. The threaded fitting 82A of the filter cartridge engages the threaded inlet port 68A of the pump discharge housing to attach the filter cartridge to the pump housing. The inlet port 68A of the housing 68 is in fluid communication with the inlet port of the pump. In an exemplary embodiment, the housing 68 defines a pump chamber 95 which surrounds a pump impeller 99 which is rotated by the pump drive. The impeller rotation drives water entering the chamber 95 from inlet port 68A to an outlet port or tube 68B, which provides a conduit from the pump outlet port to the outlet port 64 of the housing structure 60.

In one exemplary embodiment, the housing structure 60, the canister end cap 66 and the pump discharge housing 68 may each be fabricated by molding a plastic material. In an exemplary embodiment, the outlet port 68B of the pump discharge housing 68 communicates with the canister end cap 66 by a slip fit.

Pumps suitable for the purpose of pump 90 are commercially available. One exemplary type of pump is a magnetic drive pump, in which a power unit, typically encased in a water-tight case, creates a magnetic field which drives a magnetic impeller such as impeller 99. Magnetic drive pumps are marketed, e.g., by Danner Mfg. Inc., Islandia, N.Y.

In an exemplary embodiment, the housing structure 60 (FIG. 1) is adapted to support the pump so that the pump is submerged in water which is flowing through the system 50. Due to the physics of any electrical motor design configured to drive a pump, a portion of the electrical energy used in this manner is lost as heat. All electrical pumps must be designed with a cooling system to dissipate this heat, which if not captured in the water, will be lost. By submerging the pump in the bathing water, a significant portion of the exterior surface of the pump housing or pump body is in contact with water in the housing structure, which flows around the pump housing and passes into the pump inlet port 92 and is pumped out the output port 94. The water flow around the pump housing is generally indicated by arrow 54C in FIG. 1. The water flow around the pump housing may be a fraction of the total water flow through the system 50, as some or most of the water passes directly through the filter cartridge into the pump inlet port. However, water in which the pump is submerged is in thermal contact with the pump housing, allowing heat transfer between the pump and the water. As heat is generated in the pump motor during operation of the pump, at least some of the heat energy, and preferably a large percentage, greater than 50%, of the heat energy, is transferred to the water.

In an exemplary embodiment, virtually all of the heat energy generated in the pump body will be transferred to the bathing water. By placing the pump body where it is surrounded by the bathing water flow, all waste heat is delivered into the bathing water, rendering the bathing circulation pump system highly efficient, perhaps virtually 100% efficient. Simplification of the original installation and later serviceability of the pump is additionally facilitated by an innovative installation method. By installing the pump from the top outside of the spa, using simple seals to form the water seal, assembly labor is minimized, and later removal for service is simple and swift. Additionally, placing the entire pump in the bathing water protects the pump from freezing in case of power loss.

The water conditioning system 50 may further include, in an exemplary embodiment, a heater system 100 (FIG. 1) for actively heating water. In an exemplary embodiment, the heater system 100 may include an electrically powered heating element, powered by electric power delivered to heater terminals 104. The heater system may include temperature sensors 102A, 102B located adjacent the input/output ports of the heater housing 106. The temperature sensors may sense temperatures related to the temperature of water entering the heater system and the temperature of water exiting the heater system. A control system may process the temperature sensor signals, e.g. to determine whether water is present in or flowing through the heater system, and to call for heat in the event the water temperature is below a set point. Other sensors such as pressure or flow switches may be alternatively be employed to sense whether water is present in or flowing through the heater system.

Figure 1A:
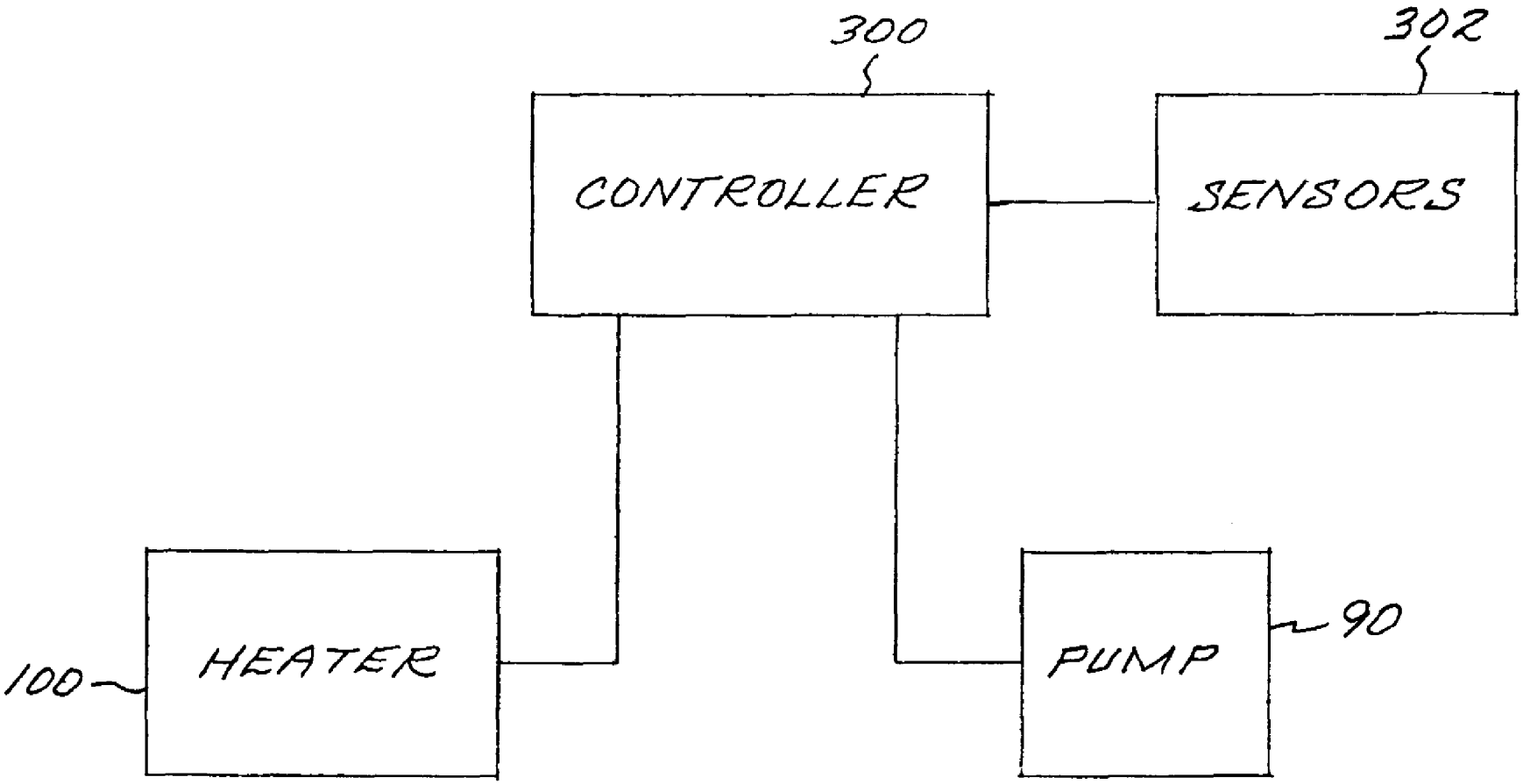
FIG. 1A is a simplified schematic diagram illustrating an exemplary controller which controls operation of a heater and pump.

FIG. 1A is a simplified schematic diagram illustrating an exemplary controller 300 which controls operation of the heater 100 and the pump 90, and receives temperature data from one or more sensors 302. The sensors 302 may include temperature sensors providing temperature data indicative of the bathing water temperature, pressure switches, flow switches, water pH sensor, and the like. In an exemplary embodiment, the controller may be a microprocessor-based control system. Exemplary heater and control systems suitable for use are described in U.S. Pat. Nos. 7,030,343, 6,643,108 and 6,282,370, the entire contents of which are incorporated herein by reference. Other heater and control systems may alternatively be employed. The heater system 100 may be connected to a source of electrical power. In an exemplary embodiment, the heater system may be activated in a manner so as to maintain a desired or set water temperature in the tub. The temperature may be selected by the user, with a control panel, for example.

Figure 3:
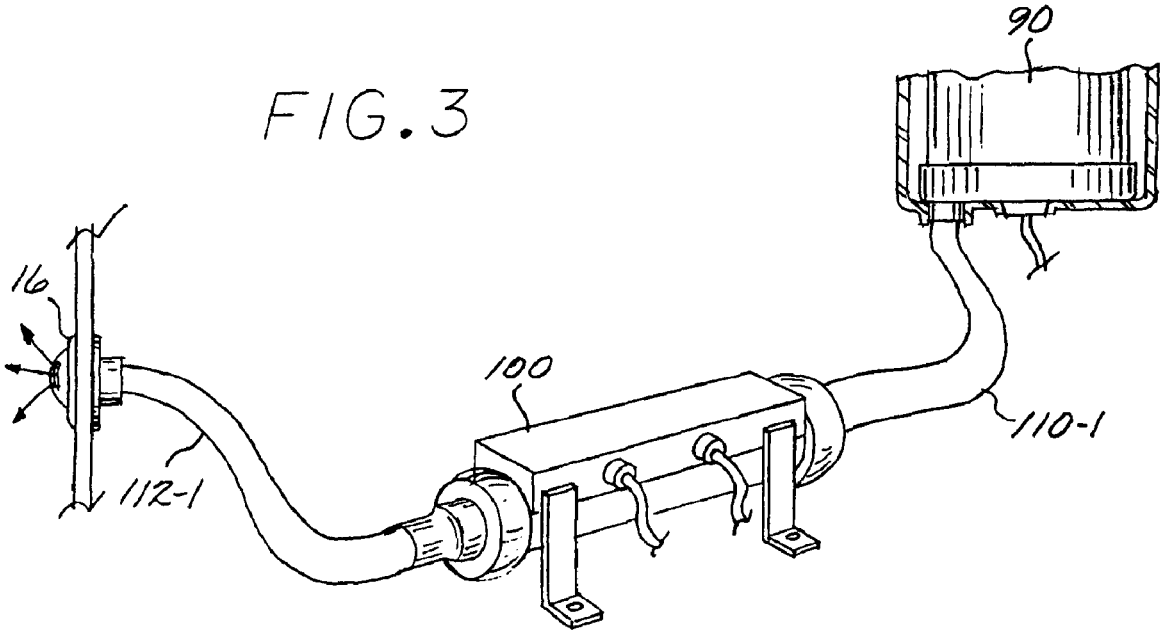
FIG. 3 is an isometric view illustrating features of an exemplary alternative embodiment of a water conditioning system.

The heater system 100 (FIG. 1) in this exemplary embodiment has an input port connected to the pump output port by a fluid conduit 110, and an output port connected to a port 16 in the tub wall by a fluid conduit 112. The fluid conduits 110, 112 may be flexible or rigid conduits, or a combination of flexible and rigid conduits. FIG. 3 depicts an exemplary embodiment in which flexible conduits 110-1 and 112-1 are employed to provide a fluid connection between the filter and pump housing structure and the heater system 100, and between the heater system and the port 16 in the tub wall.

In an exemplary embodiment, the water conditioning system 50 (FIG. 1) may include an equalizer port 65 for the housing structure 60, and a fluid conduit 120 connected between the equalizer port 65 and a port 18 in the tub wall. In the event the input port 62 of the housing structure is blocked, e.g. by covering the opening 15, and the pump is running, the suddenly increased pressure may cause water to be drawn into port 18, through conduit 120 and into the equalizer port 65, to be passed through the pump 90, thus equalizing pressure at the input port 62. This can prevent high suction conditions from occurring at the input port 62 due to obstruction of the input port during pump operations. A check valve 200 may be included to prevent flow through the equalizer port until a certain backpressure exists in the housing 60 which is sufficient to overcome the break pressure of the check valve.

The amount of power utilized by the bathing installation may be reduced by the exemplary system depicted in FIG. 1, in which the pump 90 is submerged in water passing through the conditioning system 50. Heat energy generated by the pump may be transferred to the water in the housing structure 60 in which the pump is submerged. This in turn may reduce the heat load which is to be met by the heater system 100. Depending on the set point temperature for the bathing installation and the environmental factors such as external temperature, whether the reservoir is covered, and the amount and effectiveness of any insulation, under some circumstances it may even be unnecessary to run the heater system 100 to meet the set point temperature. The amount of energy to meet the heat demands may be reduced.

In an exemplary embodiment, the housing structure 60 (FIG. 1) may include a top bracket 63 which may be secured to the tub by engagement of a threaded nut 65 engaging external threads formed on the outer surface of the housing at the tub end of the housing structure 60, tightening flange 67 against the tub surface surrounding the opening 15. The pump 90 may be fitted to a lower pump housing 69 which is fastened to the canister end cap 66, e.g. by an opposed pair of threaded fasteners 69A (FIG. 2).

In an exemplary embodiment, the installation connections for the pump 90 in the housing structure 60 are the pressure outlet to the heater 100 through outlet port 68B of the pump discharge housing 68, and port 66A sealed by O ring 98, which is a generally circular opening in the bottom of the filter vessel, through which passes the electrical cord 96. Because both of these connections are slip engaged, the means of assembly of this exemplary embodiment is extremely simple, including feeding the power wire 96 through the port 66A, lowering the pump 90 down into the housing structure through the inlet 62, and pressing the pump into place. Although fasteners may be employed, it is also contemplated that the friction of the engagement into the ports 64 and 66A may be adequate to retain the pump in place.

The skimmer weir 70 and skimmer basket 72 may be removable from the housing structure 60, permitting access to the filter cartridge 80, e.g. to remove/replace the cartridge. In an exemplary embodiment, the cartridge 80 may be removed by grasping the handle 87 (FIG. 1) of the cartridge and rotating the cartridge to disengage the fitting 82A from the inlet port of the pump discharge housing. After the cartridge is lifted out of the housing 60, the pump may be removed for servicing, by removing the screws 69A, unplugging the power cord connector, and lifting the pump 90 out of the housing.

FIGS. 4-6C illustrate features of another exemplary embodiment of a water conditioning system 150. This embodiment includes a housing structure 160 adapted to support the filter cartridge 80 and the pump 90 in a fluid flow path within the housing. This embodiment differs from the embodiment of FIGS. 1-3, in that the equalizer port 165 is located at the bottom of the canister end cap 166, instead of being located on the side of the housing barrel. Thus, the housing structure 160 includes a generally cylindrical barrel member 160A, a top bracket 163 attached to the top end of the barrel member for attaching the housing structure 160 to the tub 12, and the canister end cap 166 attached to the lower end of the barrel member. The top bracket, the barrel member and the canister end cap may, in an exemplary embodiment, be fabricated of a plastic material, and connected together by welding, adhesive, clamping or other suitable connection technique. A pump discharge housing 168 secures the pump 90 to the canister end cap, and the electrical power cord for the pump is passed out through port 166A. The pump outlet flows from outlet port 164. A check valve 200 is disposed in the equalizer port 165.

Figure 6:
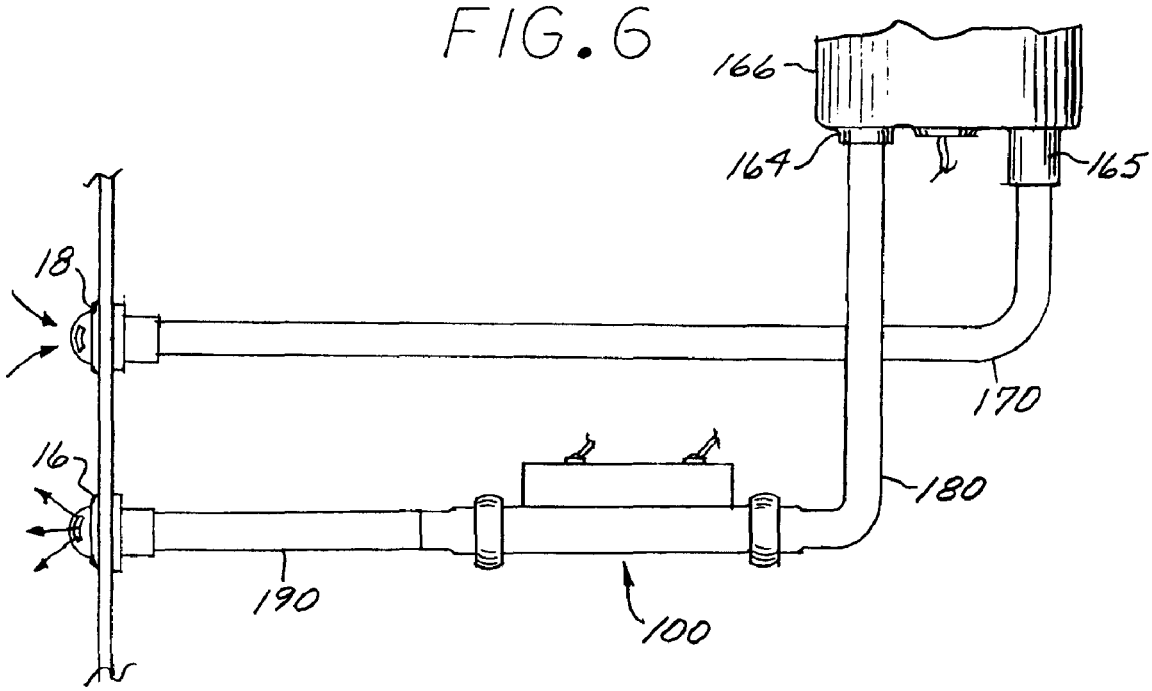
FIG. 6 is a view illustrating an exemplary connection of the water conditioning system to a bathing installation.
Figure 6A:
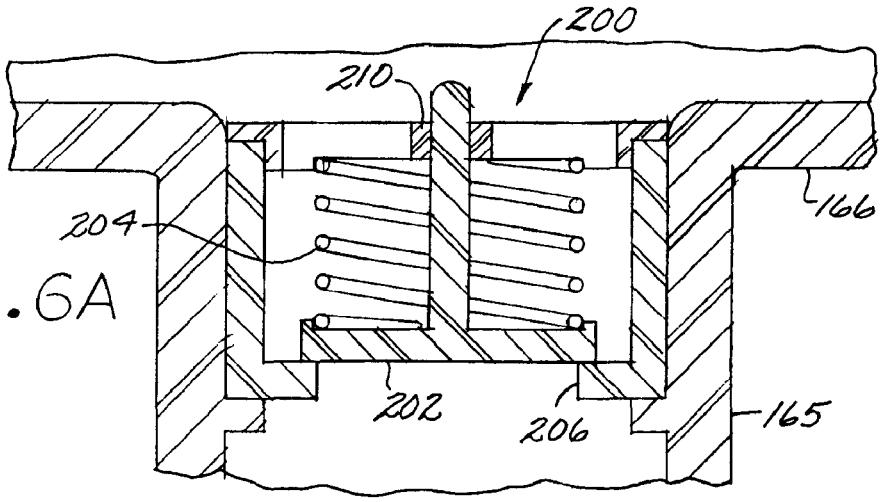
FIGS. 6A-6C illustrate features of an exemplary check valve.
Figure 6B:
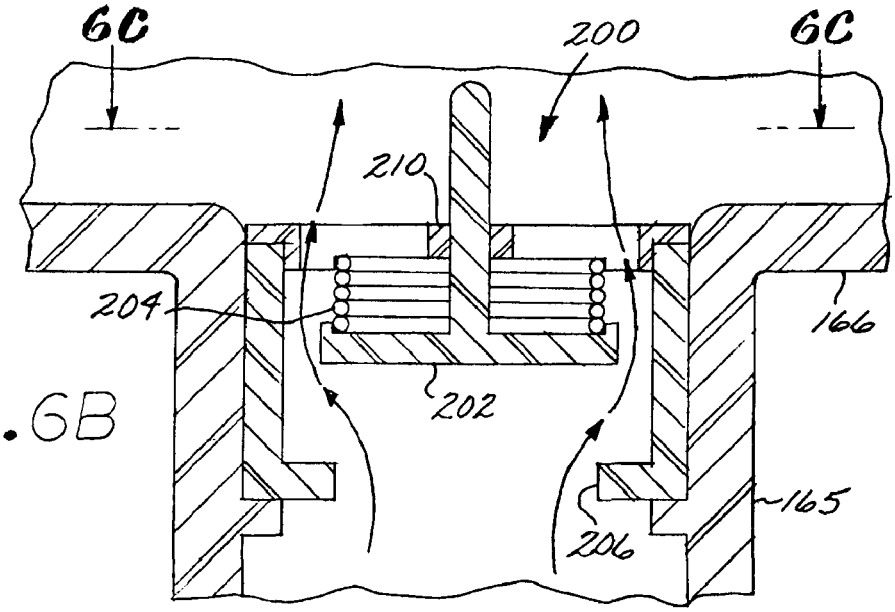
Figure 6C:
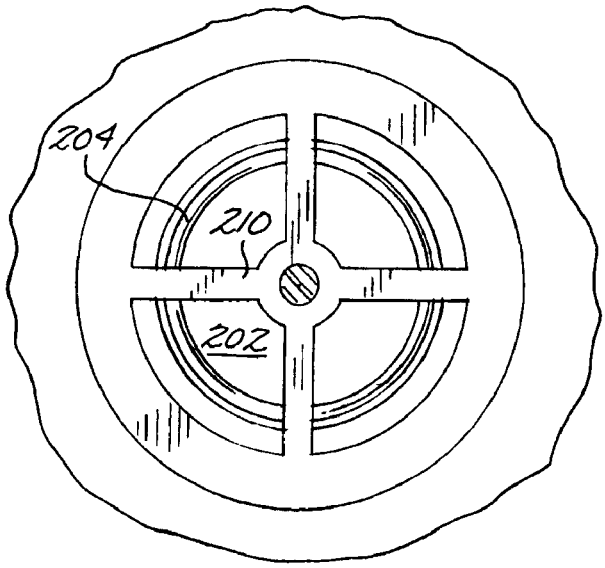

An exemplary embodiment of check valve 200 is illustrated in FIGS. 6A-6C. The check valve includes a movable valve member 202 positioned in a normally closed position (FIG. 6A) against seat 206 by a bias spring 204. When the suction pressure exceeds a check valve break pressure determined by the spring constant of spring 204, the valve member moves away from seat 206, permitting water flow through valve web 210 as illustrated in the open position in FIG. 6B. Of course, other check valve configurations may alternatively be employed.

In an exemplary embodiment, the water conditioning system may include a heater system 110, as illustrated in FIG. 6, coupled to outlet port 164 by fluid conduit 180, and to tub inlet port 16 by fluid conduit 190. The equalizer port 165 may be coupled to the tub port 18 by fluid conduit 170. The fluid conduits may be flexible tubing structures, rigid tubing structures, or a combination of flexible and rigid conduits.

Figure 4:
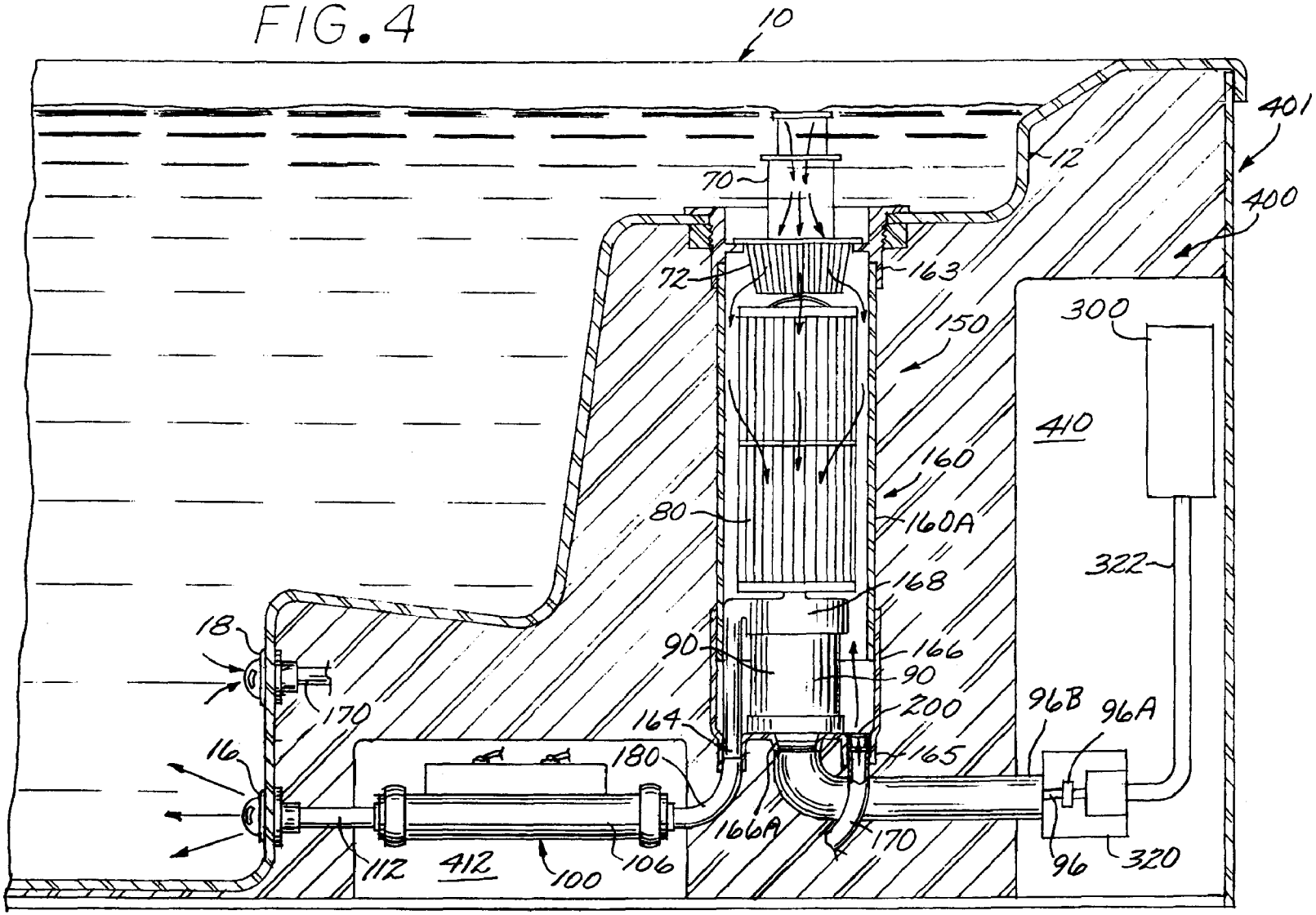
FIG. 4 is a diagrammatic view illustrating an alternative exemplary embodiment of a water conditioning system for a bathing installation.
Figure 5:
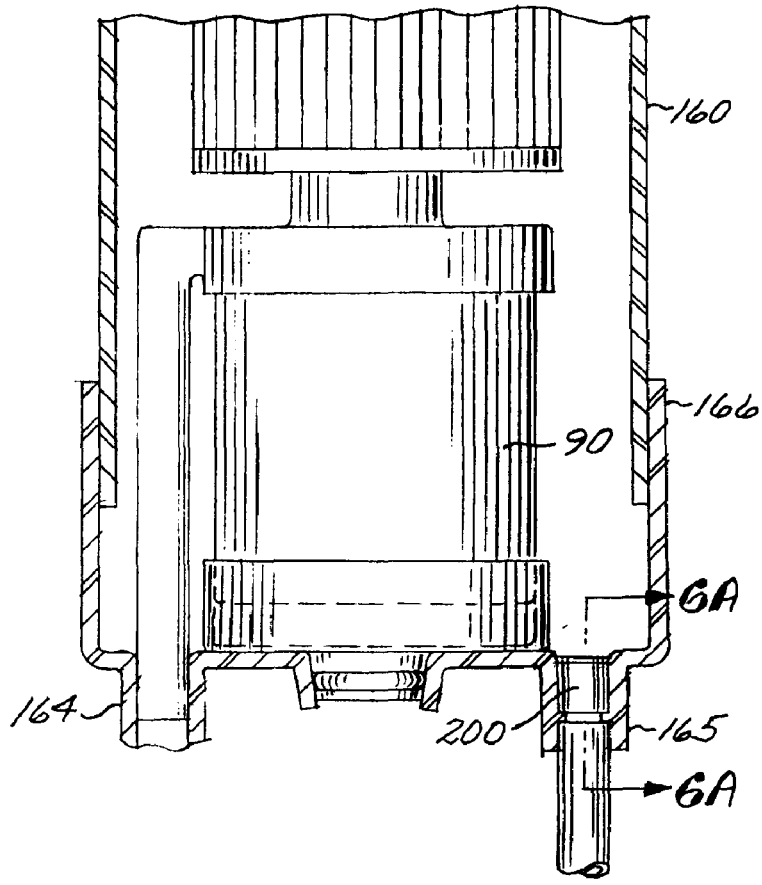
FIG. 5 is a broken-away diagram illustrating a portion of the water conditioning system of FIG. 4.

Referring to FIG. 4, in this exemplary embodiment, the pump 90 is completely submerged in the bathing water contained within the housing structure 160, which is surrounded by foam insulation 400. In the event of a power loss, the water in the housing structure is protected from freezing temperatures by the insulation 400 and the spa skirt 401 surrounding the housing structure and other components of the spa. Therefore, plumbing lines in the circulation path with the pump are not likely to freeze up unless the power outage lasts an extraordinary long time. The insulation 400 may be omitted from spaces such as space 410, 412 to allow ready access to spa components such as the heater assembly 100 and a controller 300. To facilitate servicing of the pump, a conduit 96B may be provided, in which the pump wiring 96 is run from the port 166A to a junction box 320 mounted in space 410. Electrical wiring 322 may run between the junction box 320 and the controller 300, in an exemplary embodiment in which the controller includes electrical service and switching for the pump 90. A plug or connector 96A for pump wiring 96 may connect to a mating electrical connector in the junction box 320, and may be disconnected and reconnected to allow removal and installation of a pump 90 from the housing structure 60. The pump wiring 96 may be fished through the conduit 96B for the removal/installation procedure. In other embodiments, the controller 300 may be mounted adjacent to the heater assembly 100, and in this case, the conduit 96B may be run to the space 412. In other embodiments, the pump wiring 96 may be attached to terminal blocks by pressure connectors.

Although the foregoing has been a description and illustration of specific embodiments, various modifications and changes thereto can be made by persons skilled in the art without departing from the scope and spirit of the invention as defined by the following claims. For example, while a filter cartridge has been illustrated as part of the water conditioning system 50, the filter cartridge may be omitted in some applications, or placed in another location in the water circulation path, so that the filter function is performed outside the housing structure which houses a submerged pump.

What is claimed is:

1. A water recirculation assembly for a bathing installation with a water recirculation flow path and a tub for holding bathing water, comprising:

a housing structure having an inlet opening and an outlet opening, the inlet opening adapted to be in fluid communication with bathing water in the tub, the housing structure defining a chamber;

a filter assembly disposed within the chamber and adapted to filter particulate or impurities from the bathing water;

a water pump including an electrically powered drive unit disposed within the chamber and adapted to pump bathing water which has passed into the housing structure through the inlet opening and passed through the filter assembly, said water pump having an external housing surface, the water pump and electrically powered drive unit generating waste heat during pump operation, and wherein said water pump and said housing structure are adapted such that the water pump is submerged within bathing water in the chamber of the housing structure during use to provide direct contact between the external housing surface of the pump and the bathing water in the chamber, thereby facilitating heat transfer from the water pump and the external housing surface to the bathing water.

2. The assembly of claim 1, wherein the housing structure is adapted to be attached to said tub such that the inlet opening is below a water line of water in the tub and in fluid communication with an opening in a wall of the tub.

3. The assembly of claim 1, wherein the housing structure includes a port for passing there through an electrical wiring cord for connection to a power source, and a seal structure for sealing the port against water passage.

4. The assembly of claim 1, wherein the housing assembly, the filter assembly and the water pump are adapted to be disposed in and partially define the water recirculation path.

5. The assembly of claim 1, wherein said filter assembly includes a removable filter cartridge.

6. The assembly of claim 1, wherein the housing structure is adapted for mounting to the tub in a generally vertical orientation.

7. The assembly of claim 6, further including a skimmer basket adapted to provide a coarse filtering function for water passing into the inlet opening from the tub.

8. The assembly of claim 1, wherein the housing structure further includes an equalizer port adapted to connect to an auxiliary port in a tub wall, to provide an auxiliary water input into the chamber of the housing structure in the event said inlet opening is blocked.

9. The assembly of claim 8, further comprising a check valve in a water flow path to the equalizer port to prevent water flow until a water pressure in the chamber exceeds a check valve break pressure.

10. The assembly of claim 1, further comprising:

a body of thermal insulation material surrounding the housing structure.

11. The assembly of claim 1, in which the filter assembly is in fluid communication with the inlet opening of the housing structure, and an inlet port of the pump is in fluid communication with the filter assembly such that bathing water entering the housing structure through the housing inlet opening passes through the fitter assembly and from the filter assembly to the inlet port of the pump.

12. The assembly of claim 1, wherein the filter assembly includes a filter cartridge with a threaded fitting, the pump includes a threaded port, and the threaded fitting is configured to engage the threaded port to attach the filter cartridge to the pump.

13. The assembly of claim 1, wherein the water pump includes a pump impeller driven by the drive unit.

14. A water recirculation assembly for a spa including a water recirculation flow path, a water heater and a tub for holding a reservoir of bathing water, the water recirculation assembly comprising:

a housing structure having an inlet opening and an outlet opening, the inlet opening adapted to be in fluid communication with bathing water in the tub, the outlet opening adapted to be in fluid communication with the bathing water in the tub, the housing structure defining a chamber;

a water pump disposed within the chamber and adapted to pump bathing water which has passed into the housing structure through the inlet opening out the outlet opening and into the tub, said water pump having an electrically powered drive unit and an external housing surface, and wherein said water pump and said housing structure are adapted such that the water pump is submerged in bathing water in the chamber of the housing structure, thereby facilitating transfer of waste heat generated by operation of the water pump and the electrically powered drive unit from an external housing surface of the pump to the bathing water, wherein heat generated by the pump during operation is transferred to bathing water to reduce energy consumption in heating bathing water.

15. The assembly of claim 14, wherein the housing structure is adapted to be attached to said tub such that the inlet opening is below a water line of water in the tub and in fluid communication with an opening in a wall of the tub.

16. The assembly of claim 14, further comprising an outlet port in the tub below a water line, and wherein the outlet port of the housing structure is configured to be in fluid communication with the outlet port in the tub.

17. The assembly of claim 14, wherein the housing structure includes a port for passing there through an electrical wiring cord for connection to a power source, and a seal structure for sealing the port against water passage.

18. The assembly of claim 14, wherein the housing assembly and the water pump are adapted to be disposed in and partially define the water recirculation path.

19. The assembly of claim 14, wherein the housing structure is adapted for mounting to the tub in a generally vertical orientation.

20. The assembly of claim 19, further including a skimmer basket adapted to provide a coarse filtering function for water passing into the inlet opening from the tub.

21. The assembly of claim 14, wherein the housing structure further includes an equalizer port adapted to connect to an auxiliary port in a tub wall, to provide an auxiliary water input into the chamber of the housing structure in the event said inlet opening is blocked.

22. The assembly of claim 21, further comprising a check valve in a water flow path to the equalizer port to prevent water flow until a water pressure in the chamber exceeds a check valve break pressure.

23. The assembly of claim 14, further comprising:

a body of thermal insulation material surrounding the housing structure.

* * * * *